US008611771B2

(12) United States Patent
Hironaka

(10) Patent No.: US 8,611,771 B2
(45) Date of Patent: Dec. 17, 2013

(54) IMAGE FORMING APPARATUS THAT EXECUTES A COLLECTION MODE TO COLLECT DEVELOPER DISCHARGED BY A DEVELOPING MEMBER RESPONSIVE TO PRINTING INSTRUCTION

(75) Inventor: Keita Hironaka, Oobu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 168 days.

(21) Appl. No.: 13/280,376

(22) Filed: Oct. 25, 2011

(65) Prior Publication Data

US 2012/0114344 A1 May 10, 2012

(30) Foreign Application Priority Data

Nov. 5, 2010 (JP) ..... 2010-248668

(51) Int. Cl.
*G03G 15/08* (2006.01)

(52) U.S. Cl.
USPC ..... 399/44; 399/53; 399/149; 399/257

(58) Field of Classification Search
USPC ..... 399/44, 53, 149, 257
See application file for complete search history.

(56) References Cited

U.S. PATENT DOCUMENTS

| | | | |
|---|---|---|---|
| 5,774,770 A | 6/1998 | Hiroshi | |
| 6,219,505 B1 | 4/2001 | Sato et al. | |
| 6,952,546 B2 | 10/2005 | Yoshikawa | |
| 6,954,595 B2 | 10/2005 | Tsukida et al. | |
| 7,068,956 B2 | 6/2006 | Tsukida et al. | |
| 7,756,436 B2 * | 7/2010 | Yamane | 399/71 |
| 2001/0028813 A1 | 10/2001 | Nishimura et al. | |
| 2001/0031154 A1 | 10/2001 | Sato et al. | |
| 2003/0049043 A1 | 3/2003 | Fuwazaki et al. | |
| 2004/0101322 A1 | 5/2004 | Tsukida et al. | |
| 2004/0131385 A1 | 7/2004 | Yoshikawa | |
| 2005/0201766 A1 | 9/2005 | Tsukida et al. | |

FOREIGN PATENT DOCUMENTS

| | | |
|---|---|---|
| JP | 03-015872 | 1/1991 |
| JP | H09-258553 A | 10/1997 |
| JP | 2000-112311 | 4/2000 |
| JP | 2001-109263 A | 4/2001 |
| JP | 2002-099148 | 4/2002 |
| JP | 2004-110011 A | 4/2004 |
| JP | 2004-117960 A | 4/2004 |
| JP | 2006-119594 A | 5/2006 |
| JP | 2009-020326 | 1/2009 |
| JP | 2009-069208 A | 4/2009 |
| JP | 2010-060740 A | 3/2010 |
| JP | 2011-059153 A | 3/2011 |

* cited by examiner

*Primary Examiner* — Sophia S Chen
(74) *Attorney, Agent, or Firm* — Banner & Witcoff, Ltd.

(57) ABSTRACT

An image forming apparatus includes: a photosensitive member that is configured to carry a developer image; a developing roller that is configured to supply developer to the photosensitive member; a transfer member that is configured to transfer the developer image carried on the photosensitive member to a transfer medium; and a control unit that is configured to execute a collection mode upon receiving a printing instruction for executing a printing operation but before initiating the printing operation, wherein the control unit in the collection mode is configured to: discharge the developer of one or more circumferences of the developing roller, which has been carried on the developing roller, to the photosensitive member; and collect the discharged developer by the developing roller.

14 Claims, 7 Drawing Sheets

IMAGE FORMING APPARATUS THAT EXECUTES A COLLECTION MODE TO COLLECT DEVELOPER DISCHARGED BY A DEVELOPING MEMBER RESPONSIVE TO PRINTING INSTRUCTION

CROSS-REFERENCE TO RELATED APPLICATIONS

This application claims priority from Japanese Patent Application No. 2010-248668 filed on Nov. 5, 2010, the entire subject matter of which is incorporated herein by reference.

TECHNICAL FIELD

The invention relates to an image forming apparatus.

BACKGROUND

There has been proposed an image forming apparatus that supplies toner carried on a developing roller to a photosensitive member and forms a toner image on the photosensitive member. In the image forming apparatus, the toner is always carried on the developing roller.

BRIEF DESCRIPTION OF THE DRAWINGS

FIGS. 3A-3F illustrate a process of a collection mode, in which FIG. 3A shows an initiation state of the collection mode, FIG. 3B shows a state in which toner on a developing roller is being discharged to a photosensitive drum, FIG. 3C shows a state in which all the tone is discharged from the developing roller to the photosensitive drum, FIG. 3D shows a state in which the toner discharged to the photosensitive drum is removed, FIG. 3E shows a completion state of the collection mode and FIG. 3F shows a completion state of a collection mode according to a modified embodiment.

SUMMARY

Figure 1:
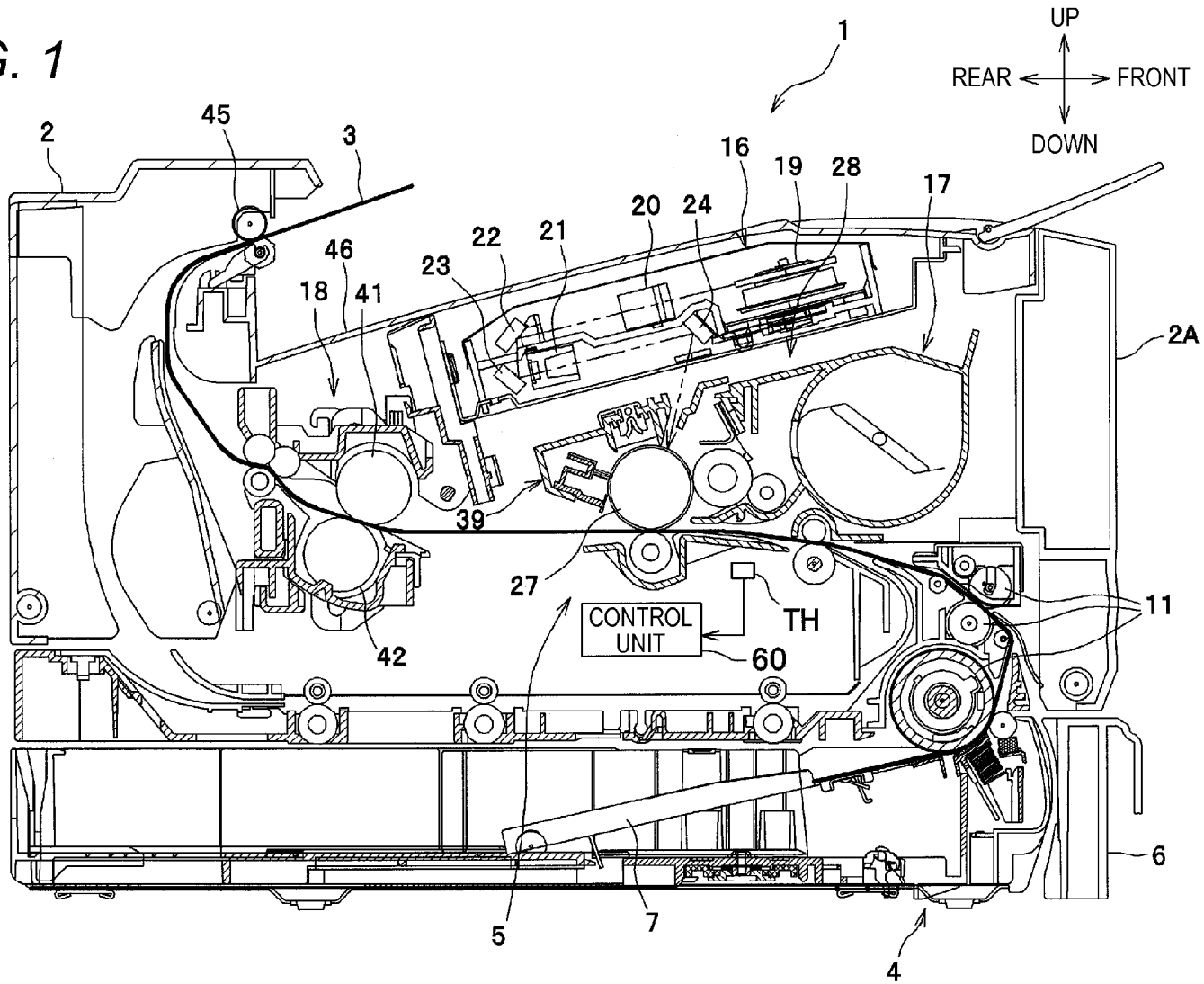
FIG. 1 is a side sectional view showing an image forming apparatus according to an exemplary embodiment of the invention.

Illustrative aspects of the invention provide an image forming apparatus capable of suppressing an image quality from being lowered due to deterioration of toner when initiating a printing operation.

DETAILED DESCRIPTION

<General Overview>

According to the above-described image forming apparatus, when there is a long tune interval after a printing operation is completed until an initiation of a next printing operation, the toner carried on the developing roller may be deteriorated due to moisture absorption in high-temperature and humidity environments, for example. When a printing operation is initiated with the deteriorated toner being carried on the developing roller, a discoloring and the like is caused, so that an image quality is lowered.

Therefore, illustrative aspects of the invention provide an image forming apparatus capable of suppressing an image quality from being lowered due to deterioration of toner when initiating a printing operation.

According to one aspect of the invention, there is provided an image forming apparatus comprising: a photosensitive member that is configured to carry a developer image; a developing roller that is configured to supply developer to the photosensitive member; a transfer member that is configured to transfer the developer image carried on the photosensitive member to a transfer medium; and a control unit that is configured to execute a collection mode upon receiving a printing instruction for executing a printing operation but before initiating the printing operation, wherein the control unit in the collection mode is configured to: discharge the developer of one or more circumferences of the developing which has been carried on the developing roller, to the photosensitive member; and collect the discharged developer by the developing roller.

According to the image forming apparatus configured as described above, the collection mode is executed upon receiving the printing instruction. Thus, it is possible to remove the deteriorated developer carried on the developing roller from the developing roller before initiating the printing operation, and the new developer is carried on the developing roller when initiating the printing operation. Therefore, it is possible to perform the printing operation by using the newly supplied developer.

According to the aspects of the invention, by executing the collection mode for collecting the deteriorated toner carried on the developing roller before the printing operation, it is possible to suppress the image quality from being lowered when initiating the printing operation.

Exemplary Embodiments

Exemplary embodiments of the invention will now be described with reference to the drawings. In the following descriptions, an overall configuration of an image forming apparatus 1 will be briefly described and then the characteristics of the invention will be described. Incidentally, a laser printer is one example of the image forming apparatus 1.

Also, in the following descriptions, the directions are described on the basis of a user who uses the image forming apparatus 1. That is, in FIG. 1, the right side is referred to as the 'front side', the left side is referred to as the 'rear side', the inner side of a direction perpendicular to the sheet is referred to as the 'right side' and the front side of the direction perpendicular to the sheet is referred to as the 'left side.' Also, the upper-lower direction of the sheet is referred to as the 'upper-lower' direction.

(Overall Configuration of Image Forming Apparatus)

As shown in FIG. 1, the image forming apparatus 1 includes, in a body casing 2, a feeder unit 4 that feeds a sheet 3 (one example of a transfer medium), an image forming unit 5 that forms an image on the sheet 3, and the like.

The feeder unit 4 includes a feeder tray 6 that is detachably mounted at a lower part in the body casing 2, a sheet pressing plate 7 that is provided in the feeder tray 6 and various rollers 11 for conveying the sheet 3 and the like. The sheet 3 received in the feeder tray 6 is deviated obliquely upwards by the sheet pressing plate 7 and is conveyed to the image forming unit 5 by the various rollers 11.

The image forming unit 5 includes a scanner unit 16, a process cartridge 17, a fixing unit 18, a control unit 60 and the like.

The scanner unit 16 is provided at an upper part in the body casing 2 and irradiates a surface of a photosensitive drum 27 with high speed scanning of laser light based on image data through a polygon mirror 19, lenses 20, 21, reflecting mirrors 22, 23, 24 and the like (refer to two-dot chain line).

The process cartridge 17 is configured such that the process cartridge 17 is detachably mounted to the body casing 2 by opening a front cover 2A provided at the front of the body casing 2. The process cartridge 17 includes a developing cartridge 28 and a drum unit 39.

The developing cartridge 28 is detachably mounted to the body casing 2 with being mounted to the drum unit 39. Incidentally, the developing cartridge 28 may be detachably mounted to the drum unit 39 fixed to the body casing 2.

Figure 2:
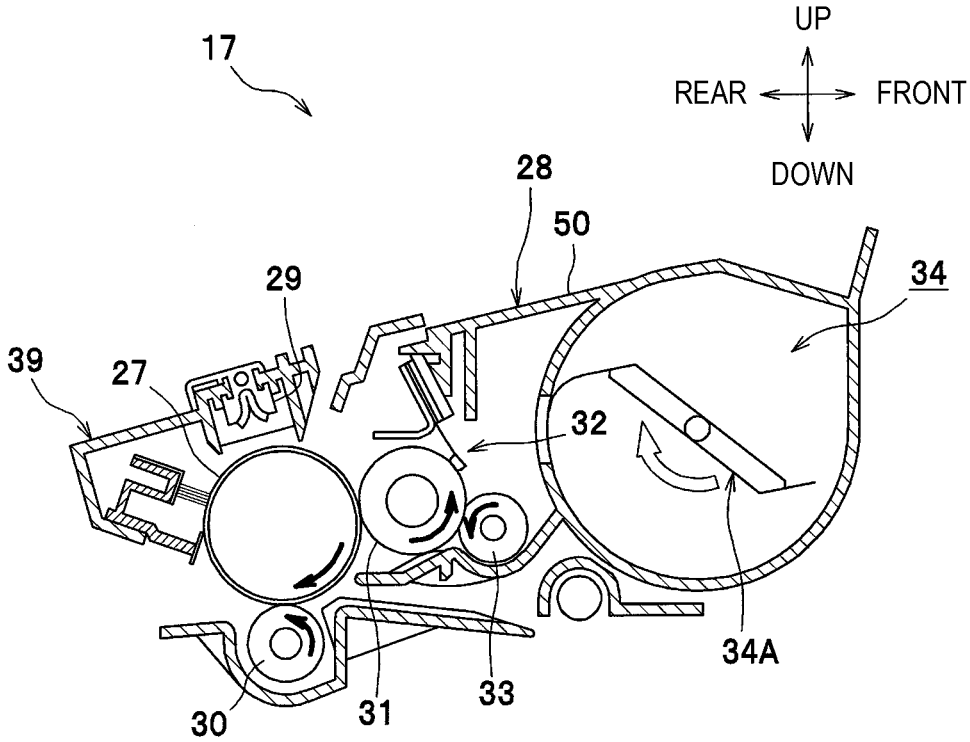
FIG. 2 is a side sectional view showing a developing cartridge.

As shown in FIG. 2, the developing cartridge 28 includes a developing frame 50, a developing roller 31, a layer thickness regulation blade 32 and a supply roller 33. A toner accommodation chamber 34 is formed in the developing frame 50.

In the developing cartridge 28, toner (one example of developer) in the toner accommodation chamber 34 is stirred by an agitator 34A and is then supplied to the developing roller 31 by the supply roller 33. At this time, the supply roller 33 and the developing roller 31 are positively friction-charged therebetween. The toner supplied on the developing roller 31 is introduced between the layer thickness regulation blade 32 and the developing roller 31 as the developing roller 31 rotates, and is carried on the developing roller 31 as a thin layer having a predetermined thickness with being friction-charged.

The drum unit 39 includes a photosensitive drum 27 (one example of a photosensitive member), a scorotron-type charger 29 and a transfer roller 30 (one example of a transfer member). In the drum unit 39, the surface of the photosensitive drum 27 is positively charged uniformly by the scorotron-type charger 29 and then exposed by the high-speed scanning of the laser light from the scanner unit 16. According thereto, a potential of the exposed part is lowered, so that an electrostatic latent image based on the image data is formed on the surface of the photosensitive drum 27.

Then, as the developing roller 31 rotates, the positively charged toner carried on the surface of the developing roller 31 is supplied to the electrostatic latent image formed on the surface of the photosensitive drum 27, so that a toner image (developer image) is formed on the surface of the photosensitive drum 27. After that, the sheet 3 is conveyed between the photosensitive drum 27 and the transfer roller 30, so that the toner image formed on the surface of the photosensitive drum 27 is transferred on the sheet 3. At this time, the transfer roller 30 is applied with a transfer bias having polarity that is opposite to the charged polarity (positive) of the toner.

As shown in FIG. 1, the fixing unit 18 includes a heating roller 41 and a pressing roller 42 that presses the heating roller 41. In the fixing unit 18, the toner transferred on the sheet 3 is heated and fixed while the sheet 3 passes between the heating roller 41 and the pressing roller 42. Incidentally, the sheet 3 heated and fixed in the fixing unit 18 is conveyed to a sheet discharge roller 45 provided downstream from the fixing unit 18 so as to be delivered to a sheet discharge tray 46 from the sheet discharge roller 45.

The control unit 60 includes a CPU, a ROM, a RAM and the like and executes a collection mode, which will be described later, in response to programs prepared in advance. Further, the control unit 60 is connected with a temperature sensor TH (one example of a detection unit). The temperature sensor TH is provided below the developing cartridge 28. The temperature sensor TH detects a temperature around the developing roller 31.

(Collection Mode)

Figure 4:
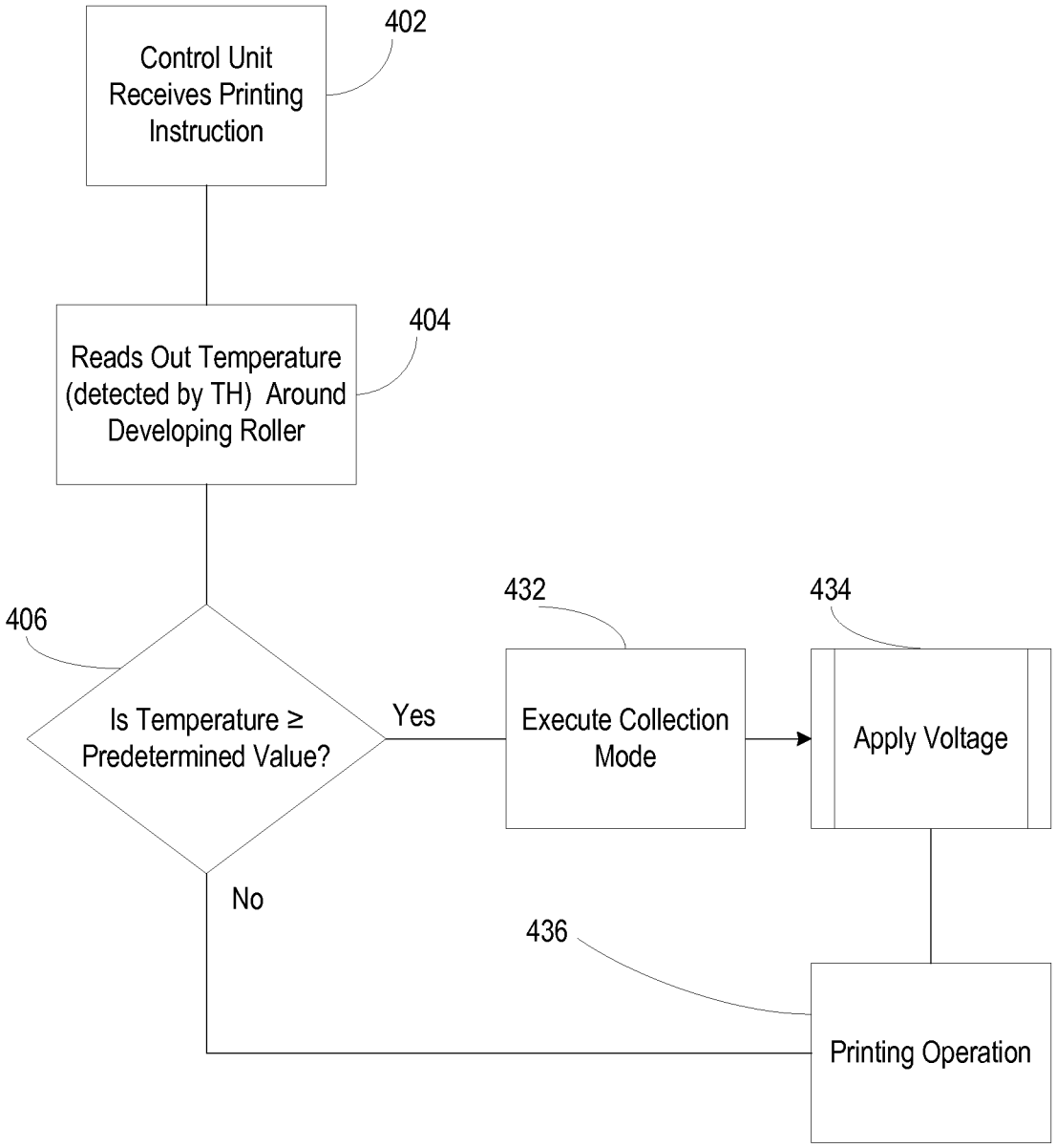
FIG. 4 provides a flow diagram showing steps taken by the control unit according to an illustrative embodiment.

Hereinafter, the collection mode executed by the control unit 60 will now be described with reference to FIG. 4.

After receiving a printing instruction for executing a printing operation in step 402, in step 404 the control unit 60 reads out the temperature around the developing roller 31, which is detected by the temperature sensor TH. Next, in step 406, the control unit 60 determines whether the temperature around the developing roller 31 is equal to or greater than a predetermined value. When the temperature is a predetermined value or greater (yes in step 406), the control unit 60 executes the collection mode in step 432 before initiating the printing operation in step 436.

In the collection mode that is executed by the control unit 60, the control unit 60 performs a control operation of discharging old toner T1 of one circumference of the developing roller 31 (refer to FIG. 3A), which is carried on the developing roller 31, to the photosensitive drum 27 and collecting the discharged old toner T1 by the developing roller 31, before the printing operation.

Figure 3A:
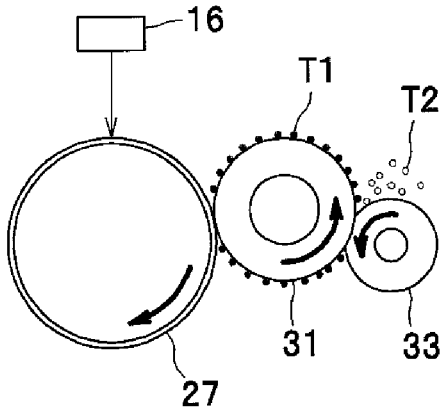

Specifically, when the collection mode is executed, as shown in FIG. 3A, the photosensitive drum 27, the developing roller 31 and the supply roller 33 are rotated. Then, the scanner unit 16 starts to expose the surface of the photosensitive drum 27, so that the surface of the photosensitive drum 27 is continuously exposed over the whole width (printing range) thereof. The exposure continues for a time period corresponding to one or more circumferences of the developing roller 31.

When the exposed surface of the photosensitive drum 27 reaches a contact portion between the photosensitive drum 27 and the developing roller 31, the old toner T1 is attracted to the photosensitive drum 27 by a potential difference between the developing roller 31 and the photosensitive drum 27. Accordingly, as shown in FIG. 3B, the old toner T1 carried on the developing roller 31 is started to be discharged to the photosensitive drum 27. Incidentally, during the execution of the collection mode in step 432, in step 434 the transfer roller 30 is applied with 0V or a voltage having the same polarity as that of the old toner T1 carried on the photosensitive drum 27, preferably a voltage higher than the exposed surface of the photosensitive drum 27. By applying the voltage in such a manner, it is possible to suppress the old toner T1 on the photosensitive drum 27 from being transferred to the transfer roller 30.

As the old toner T1 carried on the developing roller 31 is discharged to the photosensitive drum 27, new toner T2 is started to be supplied to the developing roller 31 by the supply roller 33. Then, as shown in FIG. 3C, after all the old toner T1 carried on the developing roller 31 is discharged to the photosensitive drum 27, the developing roller 31 carries all the new toner T2 thereon.

Figure 3D:
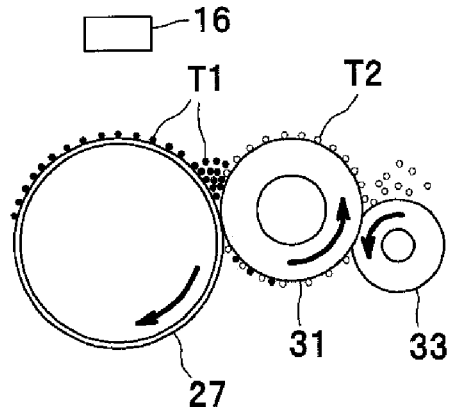
Figure 3B:
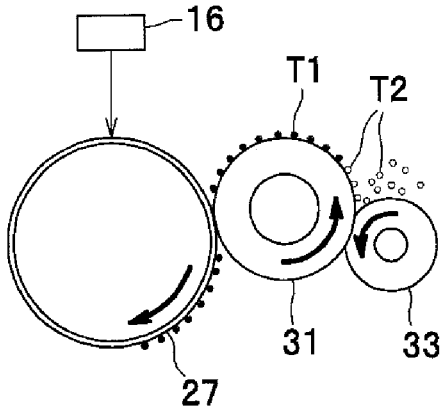

When the old toner T1 carried on the photosensitive drum 27 again reaches the contact portion between the photosensitive drum 27 and the developing roller 31, the old toner T1 is gradually collected from the photosensitive drum 27 by the developing roller 31, as shown in FIG. 3D.

Figure 3E:
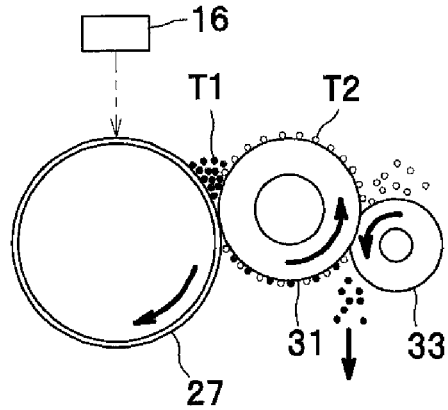
Figure 3C:
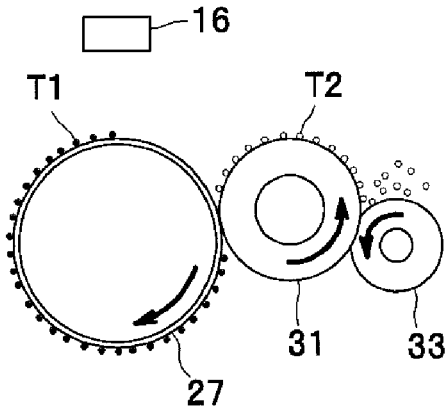

This collection mode is executed while the photosensitive drum 27 makes at least one revolution after all the old toner T1 is discharged from the developing roller 31 to the photosensitive drum 27. Thus, when the photosensitive drum 27 makes at least one revolution after the discharge completion of the old toner T1, all the old toner T1 on the photosensitive drum 27 is removed, as shown in FIG. 3E.

After completing the collection mode, the photosensitive drum 27 is exposed by the laser light based on the image data from the scanner unit 16, so that a printing operation is initiated.

Incidentally, the old toner T1 removed from the surface of the photosensitive drum 27 is collected and returned into the toner accommodation chamber 34 by the developing roller 31 after the printing operation is initiated. The toner returned into the toner accommodation chamber 34 is mixed with the new toner T2 and then reused. Thus, since the toner returned into the toner accommodation chamber 34 is mixed with the new toner T2, the old toner does not affect an image quality when reusing the same.

According to the exemplary embodiment, following operational effects can be obtained.

After receiving the printing instruction, the control unit 60 executes the collection mode in which the old toner T1 of one or more circumferences of the developing roller 31, which is carried on the developing roller 31, is discharged to the photosensitive drum 27 and the discharged old toner T1 is collected by the developing roller 31, before initiating the printing operation. Therefore, it is possible to initiate the printing operation with the new toner T2, so that it is possible to suppress the image quality from being deteriorated when initiating the printing operation.

The control unit 60 executes the collection mode when the temperature around the developing roller 31 detected by the temperature sensor TH is equal to or greater than a predetermined value in step 406. Accordingly, under high temperatures at which the toner is apt to be deteriorated, it is possible to initiate the printing operation after removing the deteriorated old toner T1 carried on the developing roller 31 in advance before the printing operation.

The control unit 60 executes the collection mode while the photosensitive drum 27 makes at least one revolution after all the old toner T1 is discharged from the developing roller 31 to the photosensitive drum 27, and then initiates the printing operation. Accordingly, it is possible to initiate the printing operation at the state in which all the old toner T1 on the photosensitive drum 27 is removed. Therefore, it is possible to suppress a poor exposure caused by the old toner T1 remaining on the photosensitive drum 27.

Since in step 434 the transfer roller 30 is applied with 0V or a voltage having the same polarity as that of the old toner T1 carried on the photosensitive drum 27 during the execution of the collection mode in step 432, it is possible to suppress the old toner T1 from being transferred to the transfer roller 30.

Although the exemplary embodiment of the invention has been described, it should be noted that the invention is not limited to the exemplary embodiment. That is, the specific configurations can be appropriately changed without departing from the gist of the invention.

In the above-described exemplary embodiment, the temperature sensor TH is adopted as the detection unit. However, the invention is not limited thereto. For example, a humidity sensor may be adopted as the detection unit. By detecting the humidity around the developing roller 31, it is possible to execute the collection mode under high humidity environments in which the toner is apt to be deteriorated.

Figure 5A:
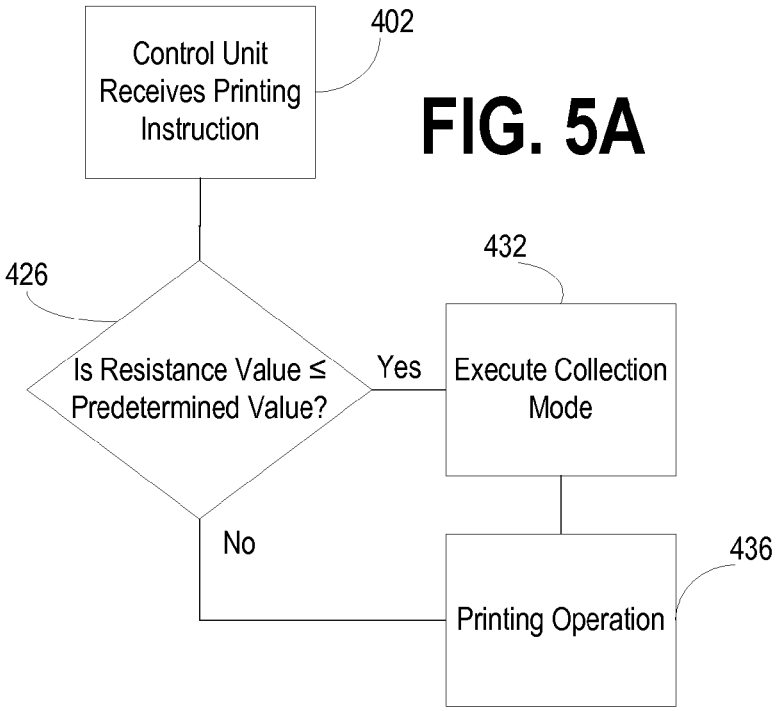
FIGS. 5A-5E illustrate various flow diagrams showing steps taken by the control unit according to alternative embodiments.

Also, it may be possible to determine whether or not a high-temperature and humidity environment exists based on a resistance value of the transfer roller 30 as shown in FIG. 5A. In the high-temperature and humidity environments, the resistance value of the transfer roller 30 made of an ion conductive material is decreased. Accordingly, when the control unit 60 determines that the resistance value of the transfer roller 30 is a predetermined value or smaller in step 426, the control unit 60 may determine that the developing roller 30 is under high-temperature and humidity environments and may execute the collection mode of step 432 (step 426: yes) before the printing operation step 436.

In the above-described exemplary embodiment, the collection mode is executed under a condition in which the temperature around the developing roller 31 is equal to or greater than a predetermined value. However, the invention is not limited thereto. For example, when a printing instruction is received in step 402 after predetermined time elapses from the completion of the printing operation by a previous printing instruction (for example, three sheets are discharged, the motor is stopped, and the like) in step 408 in FIG. 5B, when a printing instruction is initially received in step 402 after power is input in step 418 in FIG. 5C or when an operation mode returns from a sleep mode in step 412 due to a new printing instruction in step 402 in FIG. 5D, the collection mode may be executed in step 432 before the printing operation in step 436 after the printing instruction is received in step 402.

Here, the sleep mode means a state in which the temperature of the fixing unit 18 is lower than a temperature of a ready state capable of initiating the printing operation immediately.

Figure 5B:
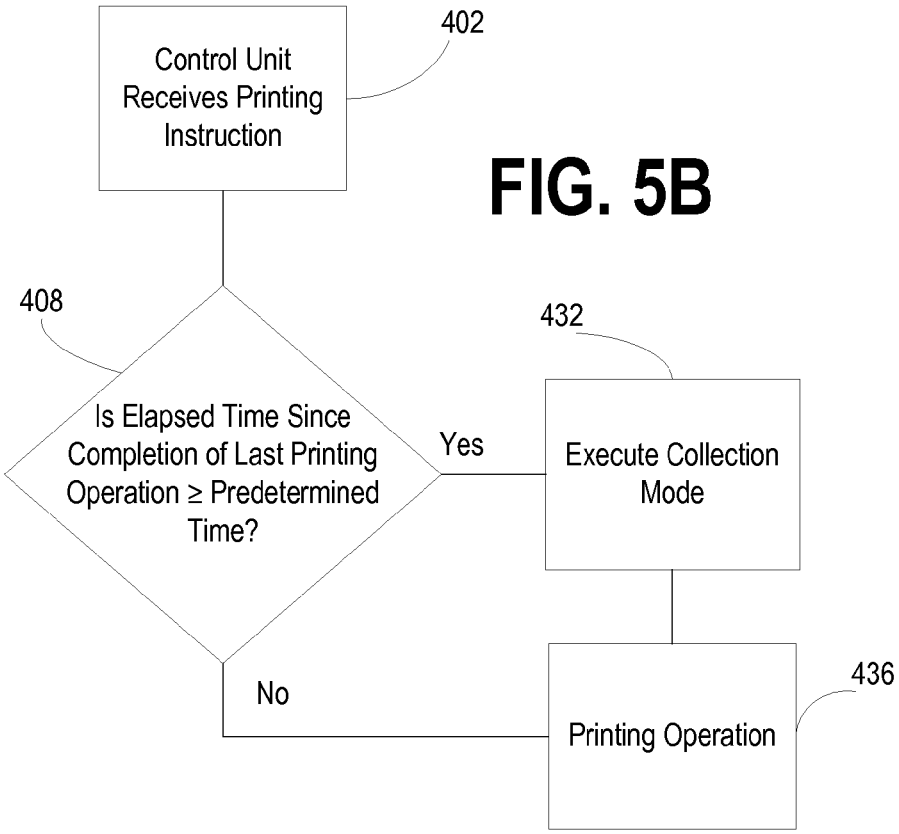
Figure 5C:
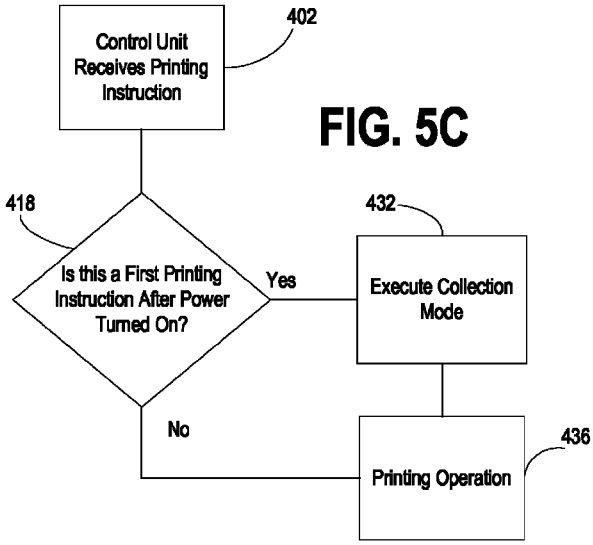
Figure 5D:
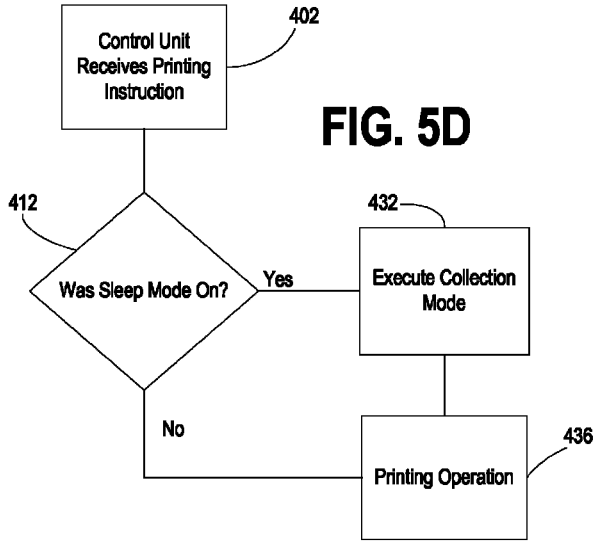

By the above configuration, even when the printing operation in step 436 is made after predetermined time elapses from the previous printing operation in step 408 of FIG. 5B, it is possible to initiate the printing operation after removing the old toner T1 carried on the developing roller 31.

Figure 5E:
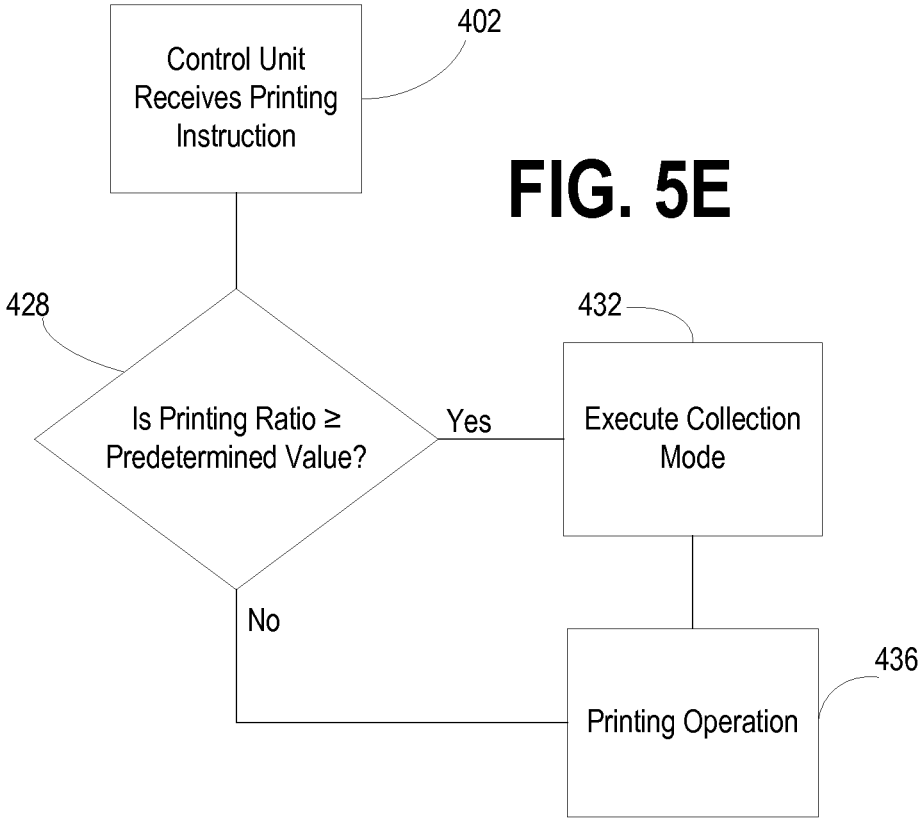

In addition, regarding the conditions of executing the collection mode, in FIG. 5E when a printing area ratio related to a printing instruction is equal to or greater than a predetermined value, in step 428, after the printing instruction is received in step 402, the collection mode may be executed in step 432 before the printing operation in step 436. For example, when printing black solids, an image quality is significantly lowered due to the deterioration of the toner. In such a case, by executing the collection mode, it is possible to suppress the image quality from being lowered.

Figure 3F:
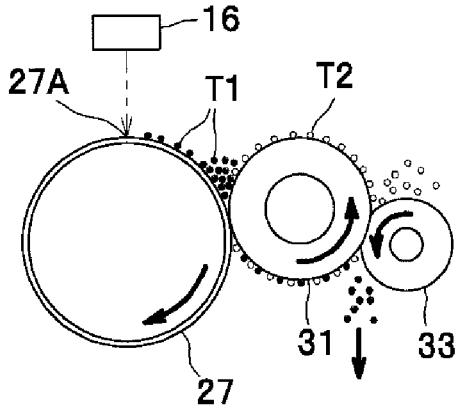

In the above-described exemplary embodiment, the collection mode is executed while the photosensitive drum 27 makes at least one revolution after all the old toner T1 is discharged from the developing roller 31 to the photosensitive drum 27. However, the invention is not limited thereto. For example, as shown in FIG. 3F, the collection mode may be executed until the old toner T1, which is discharged from the developing roller 31 to the photosensitive drum 27, passes to an exposure position 27A on the photosensitive drum 27, and then the printing operation (exposure) may be initiated. According thereto, it is possible to shorten the time in which the printing operation is initiated, compared to the above-described exemplary embodiment.

Further, the image forming apparatus 1 is not limited to the laser printer. For example, the image forming apparatus 1 may be a copier or complex machine. Further, the image forming apparatus 1 may be a color printer or color complex machine that forms a multi-color image.

What is claimed is:

1. An image forming apparatus comprising:

a photosensitive member that is configured to carry a developer image;

a developing roller that is configured to supply developer to the photosensitive member;

a transfer member that is configured to transfer the developer image carried on the photosensitive member to a transfer medium; and a control unit that is configured to execute a collection mode upon receiving a printing instruction for executing a printing operation but before initiating the printing operation, wherein the control unit in the collection mode is configured to:

discharge the developer of one or more circumferences of the developing roller, which has been carried on the developing roller, to the photosensitive member; and collect the discharged developer by the developing roller.

2. The image forming apparatus according to claim 1, wherein the control unit is configured to:

execute the collection mode at least until the developer discharged from the developing roller to the photosensitive member passes to an exposure position on the photosensitive member; and initiate the printing operation after executing the collection mode.

3. The image forming apparatus according to claim 1, wherein the control unit executes the collection mode upon receiving the printing instruction, which is received after predetermined time elapses from completion of a previous printing operation, before initiating the printing operation.

4. The image forming apparatus according to claim 1, wherein the control unit executes the collection mode when an operation mode of the image forming apparatus is returned from a sleep mode by receiving the printing instruction, before initiating the printing operation.

5. The image forming apparatus according to claim 1, wherein in a case where the control unit receives a first printing instruction after power of the image forming apparatus is turned on, the control unit executes the collection mode before the printing operation after receiving the first printing instruction.

6. The image forming apparatus according to claim 1, further comprising a detection unit that detects at least one of temperature and humidity around the developing roller, wherein the control unit executes the collection mode when a detection result detected by the detection unit is equal to or greater than a predetermined value.

7. The image forming apparatus according to claim 1, wherein the control unit executes the collection mode when a resistance value of the transfer member is equal to or smaller than a predetermined value.

8. The image forming apparatus according to claim 1, wherein the control unit executes the collection mode when a printing area ratio related to the printing instruction is equal to or greater than a predetermined value, before initiating the printing operation.

9. The image forming apparatus according to claim 1, wherein the control unit is configured to:

execute the collection mode while the photosensitive member makes at least one revolution after all of old developer is discharged from the developing roller to the photosensitive member; and initiate the printing operation after executing the collection mode.

10. The image forming apparatus according to claim 1, wherein the control unit is configured to apply the transfer member with 0V or a voltage having the same polarity as that of the developer while executing the collection mode.

11. The image forming apparatus according to claim 1, further comprising:

a developer accommodation chamber that is configured to accommodate the developer, and wherein upon the control unit initiating the printing operation, the developing roller is configured to return the collected developer into the developer accommodation chamber.

12. An image forming apparatus comprising:

a cartridge, which is detachably attached to the image forming apparatus, and which comprises:

a photosensitive member that is configured to carry a developer image;

a developing roller that is configured to supply developer to the photosensitive member; and a transfer member that is configured to transfer the developer image carried on the photosensitive member to a transfer medium; and a control unit that is configured to execute a collection mode upon receiving a printing instruction for executing a printing operation but before initiating the printing operation, wherein the control unit in the collection mode is configured to:

discharge the developer of one or more circumferences of the developing roller, which has been carried on the developing roller, to the photosensitive member; and collect the discharged developer by the developing roller.

13. The image forming apparatus according to claim 12, wherein the cartridge further comprises a developer accommodation chamber that is configured to accommodate the developer, and wherein upon the control unit initiating the printing operation, the developing roller is configured to return the collected developer into the developer accommodation chamber.

14. An image forming method by using an image forming apparatus comprising: a photosensitive member that is configured to carry a developer image; a developing roller that is configured to supply developer to the photosensitive member; and a control unit, the method comprising:

executing a collection mode upon receiving a printing instruction for executing a printing operation but before initiating the printing operation by the control unit, wherein the control unit in the collection mode is configured to:

discharge the developer of one or more circumferences of the developing roller, which has been carried on the developing roller, to the photosensitive member; and collect the discharged developer by the developing roller; and initiating the printing operation;

forming an electrostatic latent image on the photosensitive member;

supplying developer to the electrostatic latent image on the photosensitive member by the developing roller so as to form a developer image;

transferring the developer image carried on the photosensitive member to a sheet;

fixing the developer image to the sheet; and discharging the sheet.

* * * * *